US009123286B2

(12) United States Patent
Park

(10) Patent No.: US 9,123,286 B2
(45) Date of Patent: Sep. 1, 2015

(54) POWER GENERATOR HAVING A POWER SELECTOR AND ORGANIC LIGHT EMITTING DISPLAY DEVICE USING THE SAME

(75) Inventor: Sung-Cheon Park, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 401 days.

(21) Appl. No.: 13/546,484

(22) Filed: Jul. 11, 2012

(65) Prior Publication Data

US 2013/0229402 A1 Sep. 5, 2013

(30) Foreign Application Priority Data

Mar. 5, 2012 (KR) ..... 10-2012-0022336

(51) Int. Cl.
*G09G 5/00* (2006.01)
*G09G 3/32* (2006.01)

(52) U.S. Cl.
CPC ..... *G09G 3/32* (2013.01); *G09G 2330/02* (2013.01); *G09G 2330/026* (2013.01); *G09G 2330/028* (2013.01)

(58) Field of Classification Search
CPC ..... G09G 3/32; G09G 2330/028; G09G 2330/026
USPC ..... 345/87, 212; 323/282
See application file for complete search history.

(56) References Cited

U.S. PATENT DOCUMENTS 2,876,642 A 11/1956 Scorgie
2008/0174287 A1* 7/2008 Park ..... 323/271
2009/0040794 A1 2/2009 Williams
2009/0146635 A1 6/2009 Qiu et al.
2010/0033514 A1* 2/2010 Park et al. ..... 345/690
2010/0039364 A1* 2/2010 Lee ..... 345/100
2011/0175892 A1 7/2011 Lee et al.
2011/0273109 A1 11/2011 Park
2012/0050249 A1* 3/2012 Jin et al. ..... 345/212

FOREIGN PATENT DOCUMENTS

EP 2 068 298 A1 12/2008
KR 10-2010-0051096 5/2010

(Continued)

OTHER PUBLICATIONS

Linear Technology "LTC1266—Synchronous Regulator Controller for N- or P-channel MOSFETs," http://www.linear.com/product/LTC1266, 1995, 20 pages, Linear Technology Corporation, Milpitas, CA.

Gross, Tom, "Bootstrapped Synchronous Boost Converter Operates at 1.8V Input," Linear Technology Magazine, 1998, p. 37, Linear Technology Corporation, Milpitas, CA.

(Continued)

*Primary Examiner* — Jonathan Blancha
(74) *Attorney, Agent, or Firm* — Lee & Morse, P.C.

(57) ABSTRACT

A power generator includes a booster that boosts an input voltage supplied from a power supply unit and that supplies a boosted input voltage to an output terminal, a selector that selects one of the input voltage and a voltage at the output terminal as a selected voltage and supplies the selected voltage as an output voltage, a reference voltage generator that generates a reference voltage based on the output voltage, a comparator that compares a feedback voltage supplied from the booster and the reference voltage with each other, and a controller that controls the booster to output a chosen voltage from the output terminal according to a comparison result of the comparator.

18 Claims, 4 Drawing Sheets

(56) References Cited

FOREIGN PATENT DOCUMENTS

| | | |
|---|---|---|
| KR | 10-2010-0089820 | 8/2010 |
| KR | 10-2011-0084677 | 7/2011 |

OTHER PUBLICATIONS

European Office Action dated Jan. 28, 2014.
European Office Action dated Feb. 17, 2015.

* cited by examiner

POWER GENERATOR HAVING A POWER SELECTOR AND ORGANIC LIGHT EMITTING DISPLAY DEVICE USING THE SAME

CROSS-REFERENCE TO RELATED APPLICATION

This application claims priority to and the benefit of Korean Patent Application No. 10-2012-0022336, filed on Mar. 5, 2012, in the Korean Intellectual Property Office, the entire content of which is incorporated herein by reference.

BACKGROUND

Various flat panel displays having a reduced weight and volume, in which a large weight and volume are disadvantages associated with cathode ray tube type displays, are been developed. The various flat panel displays include, e.g., a liquid crystal display, a field emission display, a plasma display panel, an organic light emitting display device, and the like.

SUMMARY

Embodiments may be realized by providing a power generator including a booster boosting input voltage supplied from a power supply unit to supply the boosted input voltage to an output terminal, a selector selecting any one of the input voltage and voltage at the output terminal to supply the selected voltage as output voltage, a reference voltage generator generating reference voltage using the output voltage, a comparator comparing feedback voltage supplied from the booster and the reference voltage with each other, and a controller controls the booster so that desired voltage is output from the output terminal according to a comparison result of the comparator.

The selector may select a higher voltage among the input voltage and the voltage at the output terminal as the output voltage. The power supply unit may be a battery. The booster may include an inductor and a second switching device connected in series with each other between the power supply unit and the output terminal, a first switching device connected between a first node, which is a common terminal between the inductor and the second switching device, and a third power supply, and a first resistor and a second resistor connected in series with each other between the output terminal and the third power supply.

Voltage applied to the second node, which is a common terminal between the first resistor and the second resistor, may be used as the feedback voltage. The switching controller may control turn-on and turn-off of the first switching device and the second switching device so that the desired voltage is output from the output terminal. The power generator may further include a required voltage generator connected between the selector and the reference voltage generator and generating required voltage to be supplied to a separate block using the output voltage. The reference voltage generator may generate the reference voltage using the required voltage.

Embodiments may also be realized by providing an organic light emitting display device that includes pixels each positioned at intersection portions between scan lines and data lines and controlling an amount of current flowing from a first power supply to a second power supply via an organic light emitting diode, a power supply unit supplying input voltage, and a power generator boosting the input voltage to generate first power. The power generator includes a booster boosting the input voltage to supply the boosted input voltage to an output terminal, a selector selecting any one of the input voltage and voltage at the output terminal to supply the selected voltage as output voltage, a reference voltage generator generating reference voltage using the output voltage, a comparator comparing feedback voltage supplied from the booster and the reference voltage with each other, and a controller controls the booster so that desired voltage is output from the output terminal according to a comparison result of the comparator.

The voltage at the output terminal may be set to the first power, and the selector may select higher voltage in the input voltage and the voltage at the output terminal as the output voltage. The organic light emitting display device may further include: a scan driver supplying scan signals to the scan lines; and a data driver supplying data signals to the data lines. The data driver may supply the data signals corresponding to black to the data lines during a period in which the voltage at the output terminal is stabilized into the voltage of the first power.

The booster may include: an inductor and a second switching device connected in series with each other between the power supply unit and the output terminal; a first switching device connected between a first node, which is a common terminal between the inductor and the second switching device, and a third power supply VSS; and a first resistor and a second resistor connected in series with each other between the output terminal and the third power supply. Voltage applied to the second node, which is a common terminal between the first resistor and the second resistor, may be used as the feedback voltage. The switching controller may control turn-on and turn-off of the first switching device and the second switching device so that desired voltage is output from the output terminal. The power generator may further include a required voltage generator connected between the selector and the reference voltage generator and generating required voltage to be supplied to a separate block using the output voltage. The reference voltage generator may generate the reference voltage using the required voltage.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
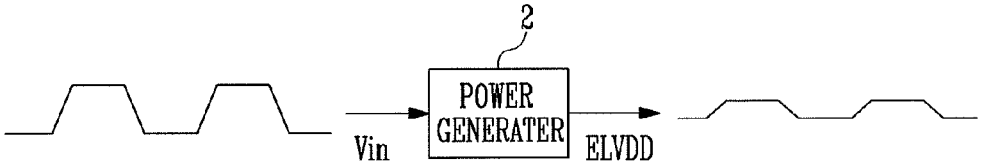
FIG. 1 is a view showing a voltage change of first power corresponding to a change in input voltage.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

The drawings and description are to be regarded as illustrative in nature and not restrictive. The dimensions of layers and regions may be exaggerated for clarity of illustration. In addition, when an element is referred to as being "on" another element, it can be directly on the other element or be indirectly on the other element with one or more intervening elements interposed therebetween. Also, when an element is referred to as being "connected to" another element, it can be directly connected to the other element or be indirectly connected to the other element with one or more intervening elements interposed therebetween. Hereinafter, like reference numerals refer to like elements.

Hereinafter, exemplary embodiments will be described in detail with reference to FIGS. 2 to 7.

Figure 2:
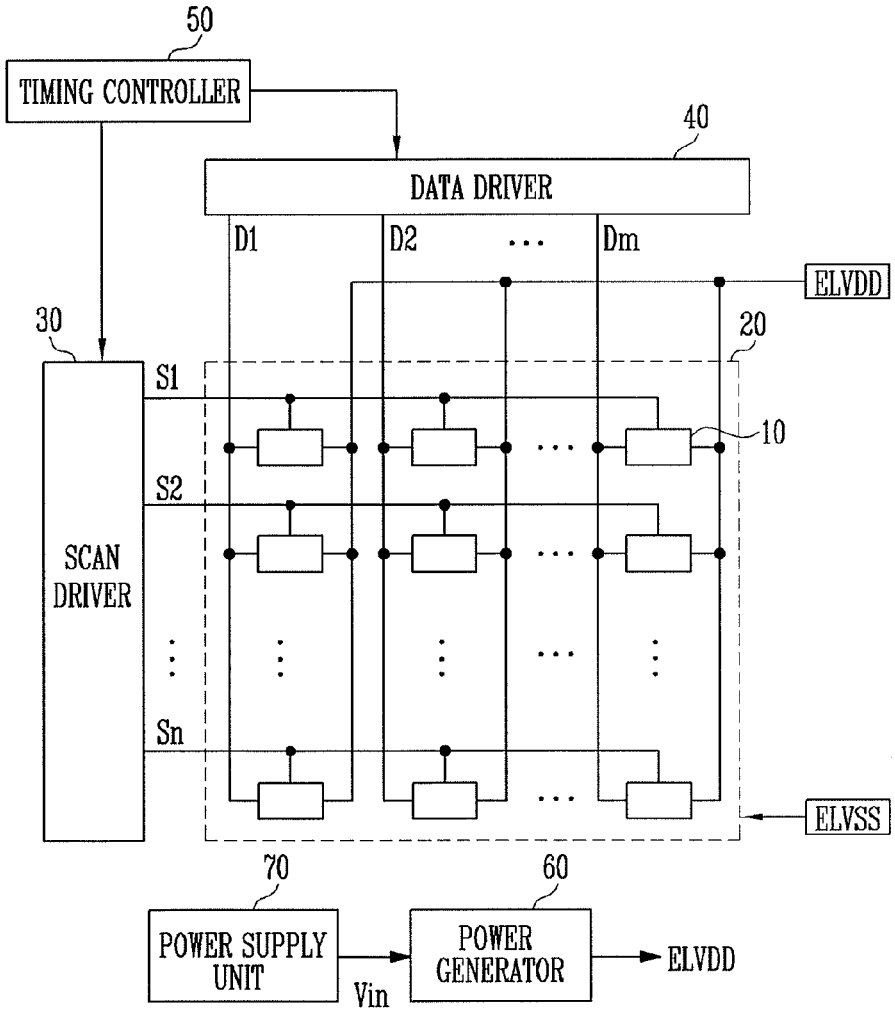
FIG. 2 is a view showing an organic light emitting display device according to an exemplary embodiment.

FIG. 2 is a view showing an organic light emitting display device including a power generator according to an exemplary embodiment.

Referring to FIG. 2, the organic light emitting display, according to the exemplary embodiment includes: a pixel unit 20 including pixels 10 connected to scan lines (S1 to Sn) and data lines (D1 to Dm), a scan driver 30 supplying scan signals to the scan lines (S1 to Sn), a data driver 40 supplying data signals to data lines (D1 to Dm), a power generator 60 generating first power ELVDD supplied to the pixels 10, a power supply unit 70 supplying input voltage Vin to the power generator 60, and a timing controller 50 controlling the scan driver 30 and the data driver 40.

The scan driver 30 sequentially supplies the scan signals to the scan lines (S1 to Sn). The pixels 10 are sequentially selected in a line unit when the scan signals are sequentially supplied to the scan lines (S1 to Sn).

The data driver 40 supplies the data signals to the data lines (D1 to Dm) so as to be synchronized with the scan signals. The data signals supplied to the data lines (D1 to Dm) are supplied to the pixels 10 selected by the scan signals.

The pixels 10 are selected when the scan signals are supplied, thereby being charged with voltage corresponding to the data signals. Further, the pixels 10 generate light having a predetermined luminance while controlling an amount of current flowing from a supplied first power ELVDD to a second power ELVSS, corresponding to the charged voltage.

The power supply unit 70 supplies the input voltage Vin to the power generator 60. Here, the power supply unit 70 may be a battery or a rectifier converting alternate current (AC) power into DC power to output the converted DC power. However, embodiments are not limited thereto, e.g., another type of power source may be used for the power supply unit 70.

The power generator 60 is supplied with the input voltage Vin and generates the firs power ELVDD using the supplied input voltage Vin. Here, the power generator 60 generates reference voltage (not shown) using the input voltage Vin or the first power ELVDD voltage according to a predetermined reference. A detailed description thereof will be provided below.

Although FIG. 2 illustrates the first power ELVDD being generated in the power generator 60, embodiments are not limited thereto. For example, the power generator 60 may additionally generate various powers that may be used for the organic light emitting display, including the second power ELVSS.

Figure 3:
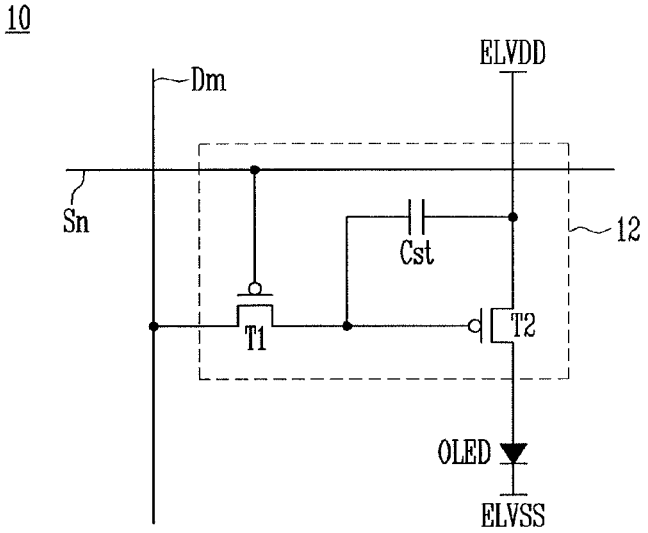
FIG. 3 is a view showing an example of a pixel shown in FIG. 2.

FIG. 3 is a view showing an example of a pixel shown in FIG. 2. In the FIG. 3, the pixel connected to an n-th scan line (Sn) and an m-th data line (Dm) will be shown for convenience of explanation.

Referring to FIG. 3, the pixel 10 according to the exemplary embodiment includes an organic light emitting diode (OLED) and a pixel circuit 12 controlling an amount of current supplied to the OLED.

An anode electrode of the OLED is connected to the pixel circuit 12, and a cathode electrode thereof is connected to the second power ELVSS. The OLED as described above may generate light having a predetermined luminance, corresponding to an amount of current supplied from the pixel circuit 12.

The pixel circuit 12 is charged with voltage corresponding to the data signal supplied from the data line (Dm) when the scan signal is supplied to the scan line (Sn). Further, an amount of current supplied to the organic light emitting diode, corresponding to the charged voltage is controlled. To this end, the pixel circuit 12 includes a first transistor T1, a second transistor T2, and a storage capacitor Cst.

A gate electrode of the first transistor T1 is connected to the scan line Sn, and a first electrode thereof is connected to the data line Dm. In addition, a second electrode of the first transistor T1 is connected to one side terminal of the storage capacitor Cst. The first transistor T1 as described above is turned on when the scan signal is supplied to the scan line Sn, thereby supplying the data signal from the data line Dm to one side terminal of the storage capacitor Cst. At this time, the storage capacitor Cst is charged with the voltage corresponding the data signal. The first electrode is set to any one of a source electrode and a drain electrode, and the second electrode is set to the other of the source electrode and the drain electrode. For example, when the first electrode is set to the source electrode, the second electrode is set to the drain electrode.

A gate electrode of the second transistor T2 is connected to one side terminal of the storage capacitor Cst, and a first electrode thereof is connected to the other side terminal of the storage capacitor Cst and the first power ELVDD. Further, a second electrode of the second transistor T2 is connected to the anode electrode of the organic light emitting diode. The second transistor T2 as described above controls an amount of current flowing from the supplied first power ELVDD to the a supply of the second power ELVSS via the organic light emitting diode, corresponding to the voltage stored at the storage capacitor Cst. At this time, the organic light emitting diode generates the light corresponding to an amount of current supplied from the second transistor T2.

A structure of the pixel circuit 12 of FIG. 3 described above is only an example. Therefore, embodiments are not limited thereto, e.g., the pixel circuit 12 may have a circuit structure capable of supplying the current to the organic light emitting diode and may have any one of well-known various structures.

Figure 4:
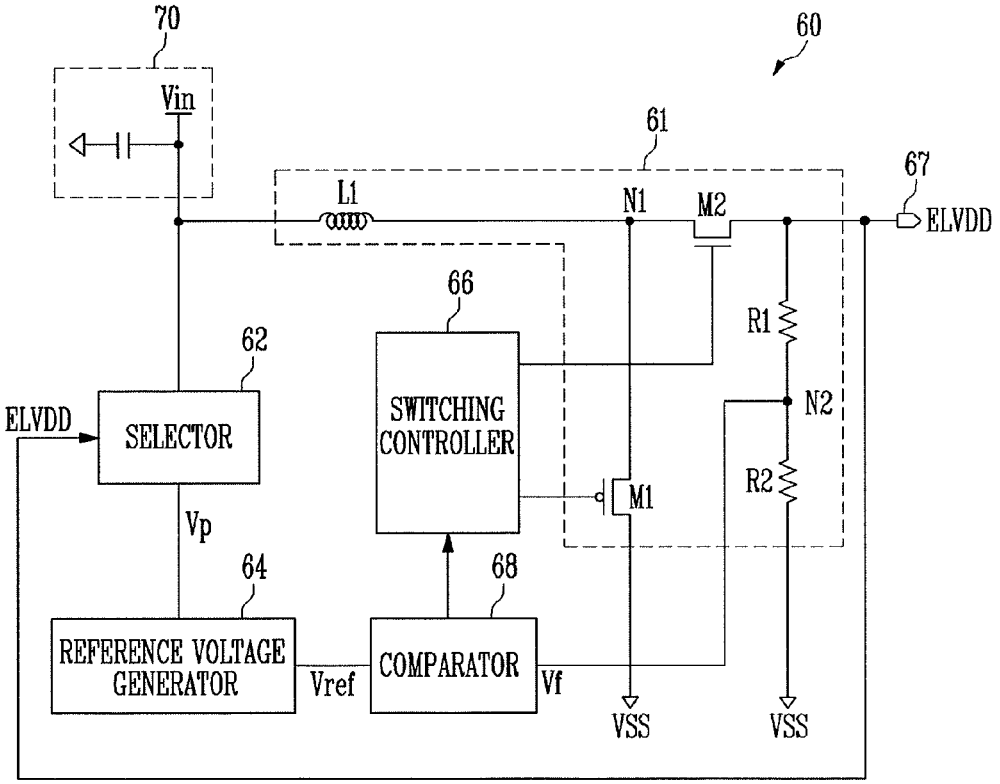
FIG. 4 is a view showing an example of a power generator shown in FIG. 2.

FIG. 2 is a view showing a power generator 60 according to the exemplary embodiment. Referring to FIG. 4, the power generator 60 according to the exemplary embodiment may include a booster 61, a selector 62, a reference voltage generator 64, a switching controller 66, and a comparator 68.

The booster 61 boosts the input voltage Vin from the power supply unit 70 according to a control of the switching controller 66 to generate the first power ELVDD. To this end, the booster 61 includes an inverter L1, a first switching device M1, a second switching device M2, a first resistor R1, and a second resistor R2.

The inductor L1 is connected between the power supply unit 70 and an output terminal 67. In the inductor L1 as described above, an amount of current is controlled corresponding to a current pass controlled by the switching controller 66.

The second switching device M2 is connected between the inductor L1 and the output terminal 67. The second switching device M2 as described above is turned on or turned off according to a control of the switching controller 66.

The first switching device M1 is connected between a first node N1, which is a common terminal between the inductor L1 and the second switching device M2, and a third power supply VSS. The first switching device M1 as described above is turned on or turned off according to a control of the switching controller 68. For example, the first switching device M1 and the second switching device M2 may be alternatively turned on and turned off. Therefore, the first switching device M1 and the second switching device M2 may have different conductive types. As an example, in the case in which the first switching device M1 is formed of a PMOS transistor, the second switching device M2 is formed of an NMOS transistor.

The first resistor R1 and the second resistor R2 are connected in series with each other between the output terminal 67 and the third power supply VSS. Feedback voltage (Vf) is applied to a second node N2, which is a common terminal between the first resistor R1 and the second resistor R2 connected in series with each other. The feedback voltage Vf is applied to the comparator 68.

The third power VSS is set to voltage lower than the first power ELVDD so that the current may flow in the first node N1. In addition, a current measurer (not shown) may be further included between the first switching device M1 and the third power supply VSS. Although FIG. 4 shows only minimum components of the booster 61 for convenience of explanation, the booster 61 may be actually configured of a circuit having known various shapes.

The switching controller 66 controls the turning on and the turning off of the first and second switching devices M1 and M2 according to a comparison result of the comparator 68 (that is, a control signal). For example, the switching controller 66 may control a duty ratio between the first and second switching devices M1 and M2 to generate the first power ELVDD for a first power supply having a desired and/or chosen voltage.

The selector 62 is supplied with the input voltage Vin from the power supply unit 70 and the first power ELVDD from the output voltage 67. The selector 62 supplied with the input voltage Vin and the first power ELVDD compares the input voltage and voltage of the first power ELVDD with each other and supplies power (the input voltage Vin or the first power ELVDD) having high voltage as output voltage Vp to the reference voltage generator 64 according to a comparison result.

In this case, the selector 62 supplies the input voltage Vin as the output voltage Vp to the reference voltage generator 64 during an initial period (for example, at the instant when the power is to the organic light emitting display) and supplies the first power ELVDD as the output voltage Vp to the reference voltage generator 64 for a period other than the initial period.

The reference voltage generator 64 generates reference voltage Vref using the output voltage Vp and supplies the generated reference voltage Vref to the comparator 68. The reference voltage Vref may be set to a predetermined voltage value.

In the case in which the reference voltage Vref is generated using the input voltage Vin in the reference voltage generator 64, a range of the reference voltage Vref may be changed corresponding to a change in the input voltage Vin. On the other hand, the first power ELVDD may be maintained as a stable voltage value by comparing the input voltage Vin with the voltage generated in the booster 61 so as to be maintained as a constant voltage value. Accordingly, in the case in which the reference voltage Vref is generated using the first power ELVDD, the reference voltage Vref may be maintained as the constant voltage.

The comparator 68 compares the reference voltage Vref and the feedback voltage Vf with each other and supplies a control signal to the switching controller 66 according to a comparison result. Since the reference voltage Vref is maintained as stable voltage, the comparator 68 may supply a control signal, e.g., corresponding to an exact result, to the switching controller 66 according to a change in the feedback voltage Vf. In this case, the switching controller 66 may control the turning on and the turning off of the first and second switching devices M1 and M2 so that stable voltage of the first power ELVDD may be generated according to the control signal.

Figure 5:
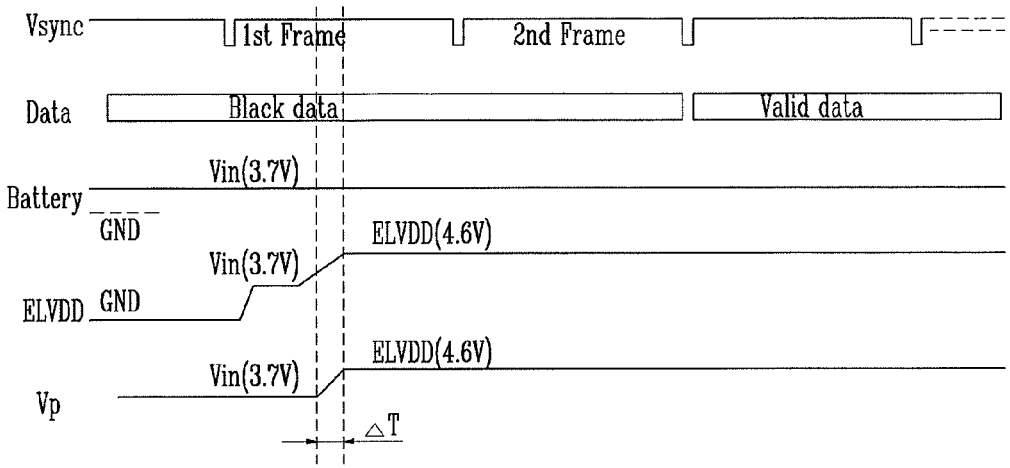
FIG. 5 is a waveform diagram showing an operating process of the power generator.

FIG. 5 is a waveform diagram showing an operating process of the power generator.

Referring to FIG. 5, when the power is supplied, voltage of the first power ELVDD is set to the input voltage Vin of the power supply unit 70. In addition, the input voltage Vin is gradually increased to a preset voltage of the first voltage ELVDD by the booster 61. Here, in the case in which voltage at the output terminal 67 exceeds the input voltage Vin, the reference voltage generator 64 generates the reference voltage Vref using the voltage at the output terminal 67.

In this case, the reference voltage Vref may be partially changed corresponding to an increase in the voltage at the output terminal 67. As an example, the reference voltage Vref is not stabilized, but may be changed corresponding to the increase in the voltage at the output terminal 67 during a predetermined period (ΔT). Then, the voltage at the output terminal 67, e.g., output voltage Vp, is stabilized into the voltage of the first power ELVDD, such that the reference voltage Vref may be stably maintained as a constant voltage.

When power is supplied to the organic light emitting display device, the data driver 40 supplies black data for at least one frame period, such that the pixel unit 20 displays a black image. The voltage at the output terminal 67 is stabilized into the voltage of the first power ELVDD during a frame period in which the black data is supplied, thereby making it possible to stably output a desired and/or chosen voltage of the first power ELVDD without deterioration in display quality. After the at least one frame period, e.g., a first and second frame period, during which the data driver 40 supplies black data valid data may be supplied to the pixel unit 20 to display a true image.

Figure 6:
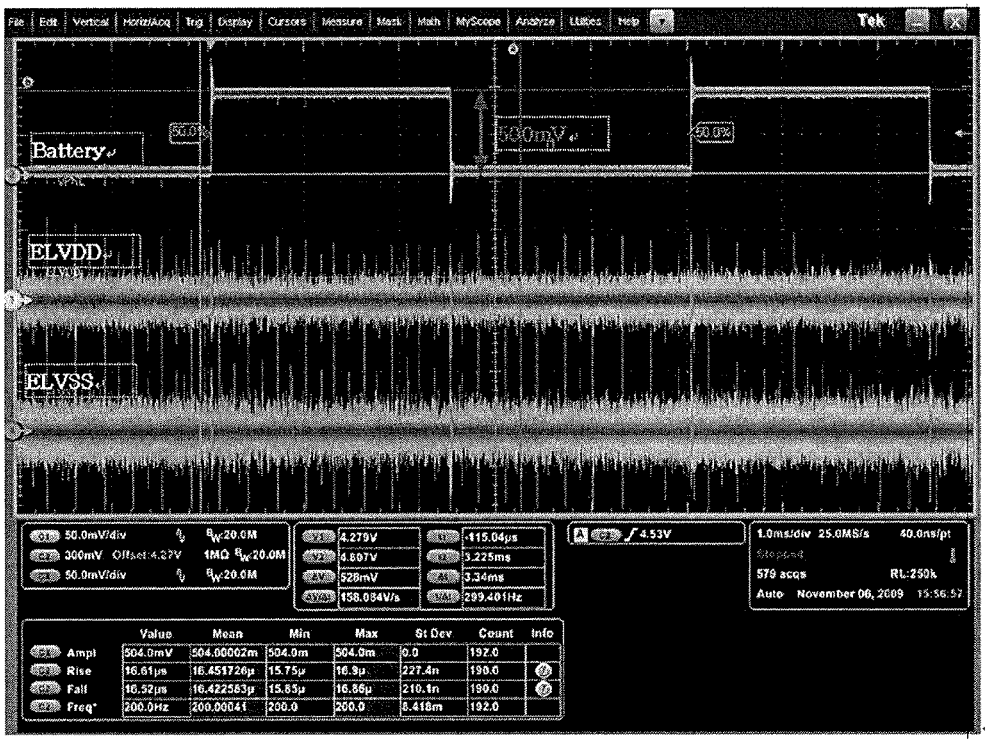
FIG. 6 is a view showing a simulation result of a voltage change of a first power corresponding to a change in input voltage.

FIG. 6 is a view showing a simulation result of a voltage change of a first power corresponding to a change in input voltage.

Referring to FIG. 6, although the input voltage Vin is increased or decreased by a 500 mV unit, the voltage of the first power ELVDD is stably maintained as a constant voltage. In other words, since the reference voltage Vref is generated using the voltage of the first power ELVDD regardless of the input voltage Vin, stabilization of the voltage may be improved.

Figure 7:
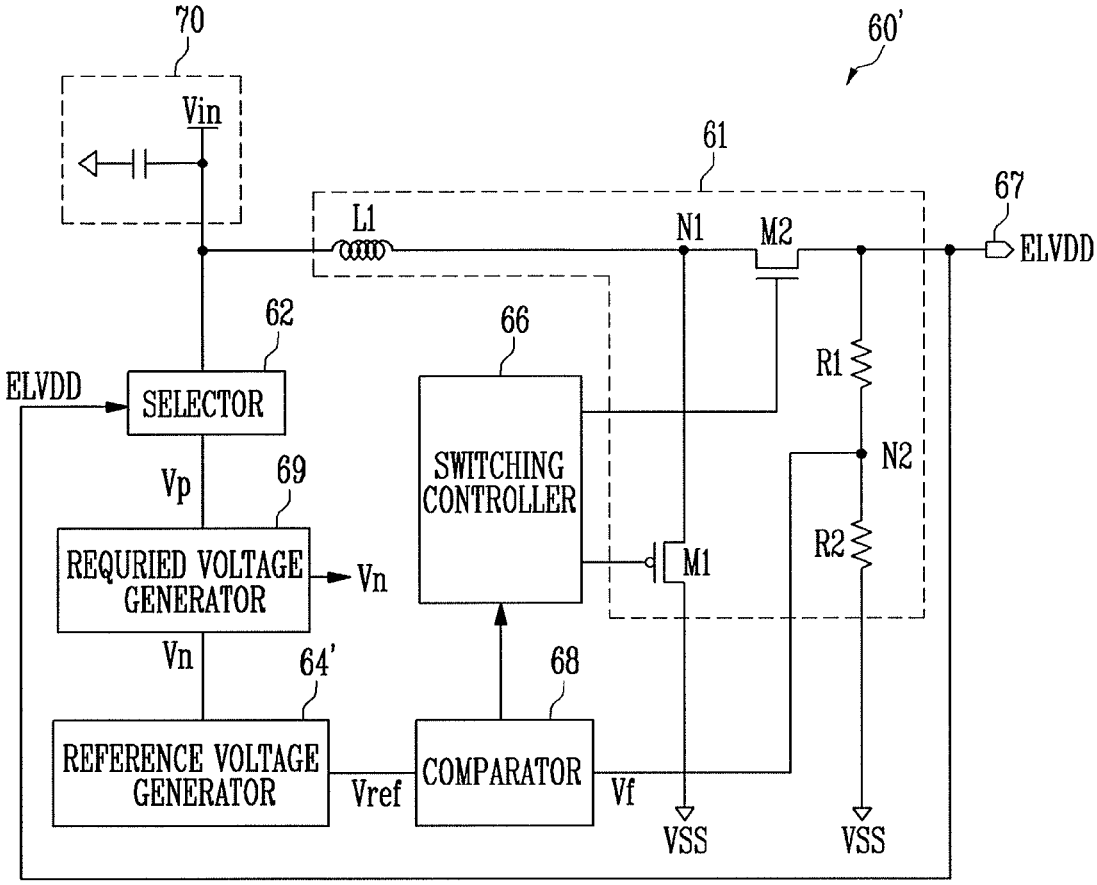
FIG. 7 is a view showing an organic light emitting display device according to an exemplary embodiment.

FIG. 7 is a view showing a power generator 60' according to another exemplary embodiment. The power generator 60' is similar to the power generator 60 and differences therebetween are mainly described.

Referring to FIG. 7, the power generator 60' according to the other exemplary embodiment further includes a required voltage generator 69 installed between the selector 62 and a reference voltage generator 64'.

The required voltage generator 69 may additionally generate a required voltage Vn using the output voltage Vp supplied from the selector 62. The required voltage generator 69 may additionally generate the required voltage Vn that is, e.g., required for driving the organic light emitting display device, using the voltage of the first power ELVDD supplied as the output voltage Vp. The generated required voltage Vn may be supplied to the reference voltage generator 64' and a separate block.

The required voltage Vn may be generated from the stable first power ELVDD, such that it has high reliability. In addition, since the required voltage Vn is voltage generated from the first power ELVDD and may have additional secured stability, stability and reliability of the reference voltage Vref generated in the reference voltage generator 64 may be additionally secured.

As set forth above, with the power generator and the organic light emitting display device using the same according to the exemplary embodiments, in the case in which the voltage of the first power exceeds the input voltage of the battery, the reference voltage is generated using the voltage of the first power. Here, the first power is voltage having a change lower than a change in the input voltage. Therefore, the reference voltage generated by the first power is almost maintained as a constant voltage. Accordingly, in the case in which the booster is controlled using the reference voltage, the voltage of the first power may be maintained as a constant voltage regardless of a change in the input voltage.

By way of summation and review, among the various flat panel displays, the organic light emitting display device (which may display an image using an organic light emitting diode generating light by recombination between an electron and a hole) has advantages in that it has a rapid response speed and is driven at low power. The organic light emitting display device includes pixels positioned at intersections between data lines and scan lines, a data driver supplying data signals to data lines, and a scan driver supplying scan signals to scan lines. The scan driver may sequentially supply the scan signals to the scan lines. The data driver may supply the data signals by the data lines so as to be synchronized with the scan signals.

The pixels are selected when the scan signals are supplied to the scan lines, thereby receiving the data signals from the data lines. In the pixel receiving the data signal, a storage capacitor may be charged with voltage corresponding to a difference between the data signal and first power. Then, the pixel generates light having a predetermined luminance while supplying current, which corresponds to the voltage charged in the storage capacitor, from a first power supply to a second power supply via an organic light emitting diode.

The first power supply, which is a power supply that supplies current to the pixel simultaneously with determining the voltage charged in the pixel, should maintain stable voltage regardless of an external environment. As shown in FIG. 1 a power generator 2 may generate a first power ELVDD using input voltage Vin supplied from, e.g., a battery of a mobile display apparatus. However, the input voltage Vin supplied from the battery may be changed corresponding to an external environment, e.g., at the time of a telephone call being received on the mobile display apparatus, when a portable terminal communicates with a base station, and the like. In this case, voltage of the first power ELVDD may be changed corresponding to a change in the input power Vin, such that noise such as flicker, or the like, may be generated.

In contrast, embodiments relate to a power generator capable of generating stable voltage and an organic light emitting display device using the same.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A power generator, comprising:

a booster that receives an input power supplied from a power supply unit, generates a first power using the input power, and supplies the first power to an output terminal;

a power selector that receives the input power and the first power, and selects one of the input power and the first power at the output terminal to supply selectively the input power and the first power as a reference power;

a reference voltage generator that receives only one of the input power and the first power as the reference power from the power selector, and generates a reference voltage using the reference power;

a comparator that compares a feedback voltage supplied from the booster and the reference voltage with each other; and a controller that controls the booster to output a chosen voltage from the output terminal according to a comparison result of the comparator.

2. The power generator of claim 1, wherein the power selector selects a power having a higher voltage among the input power and the first power at the output terminal as the reference power.

3. The power generator of claim 1, wherein the power supply unit is a battery.

4. The power generator of claim 1, wherein the booster includes:

an inductor and a second switching device connected in series with each other between the power supply unit and the output terminal, a first switching device connected between a first node and a third power, the first node being a common terminal between the inductor and the second switching device, and a first resistor and a second resistor connected in series with each other between the output terminal and the third power.

5. The power generator of claim 4, wherein:

a second node is a common terminal between the first resistor and the second resistor, and a voltage applied to the second node corresponds to the feedback voltage.

6. The power generator of claim 4, further comprising a switching controller that controls turned-on states and turned-off states of the first and second switching devices such that the first power is generated and output to the output terminal.

7. The power generator of claim 1, wherein:

the reference voltage generator includes a required voltage generator and a reference voltage generator core, and the required voltage generator is connected between the power selector and the reference voltage generator core, and generates a required voltage to be supplied to a separate block using the reference power.

8. The power generator of claim 7, wherein the reference voltage generator core generates the reference voltage using the required voltage.

9. The power generator of claim 1, wherein:

when the booster does not boost the input power, a voltage level of the first power is lower than or equal to that of the input power, and the power selector outputs the input power to the reference voltage generator, and when the booster boosts the input power, the voltage level of the first power is higher than that of the input power, and the power selector outputs the first power to the reference voltage generator.

10. An organic light emitting display device, comprising:

pixels positioned at intersection portions between scan lines and data lines, the pixels controlling an amount of current flowing from a first power supply to a second power supply via an organic light emitting diode;

a power supply unit that supplies an input power; and a power generator that boosts the input power to generate a first power, the power generator including:

a booster that receives the input power, generates the first power using the input power, and supplies the first power to an output terminal;

a power selector that receives the input power and the first power, and selects one of the input power and the first power at the output terminal to supply selectively the input power and the first power as a reference power;

a reference voltage generator that receives only one of the input power and the first power as the reference power from the power the power selector, and generates a reference voltage using the reference power;

a comparator that compares a feedback voltage supplied from the booster and the reference voltage with each other; and a controller that controls the booster to output a chosen voltage from the output terminal according to a comparison result of the comparator.

11. The organic light emitting display device of claim 10, wherein the selector selects a power having a higher voltage among the input power and the first power at the output terminal as the reference power.

12. The organic light emitting display device of claim 10, further comprising:

a scan driver that supplies scan signals to the scan lines; and a data driver that supplies data signals to the data lines.

13. The organic light emitting display device of claim 12, wherein the data driver supplies to the data lines data signals corresponding to black, during a period of the booster in which the first power at the output terminal is increased and settled at a target voltage level.

14. The organic light emitting display device of claim 10, wherein the booster includes:

an inductor and a second switching device connected in series with each other between the power supply unit and the output terminal, a first switching device connected between a first node and a third power, the first node being a common terminal between the inductor and the second switching device, and a first resistor and a second resistor connected in series with each other between the output terminal and the third power.

15. The organic light emitting display device of claim 14, wherein a second node is a common terminal between the first resistor and the second resistor, and a voltage applied to the second node corresponds to the feedback voltage.

16. The organic light emitting display device of the claim 14, further comprising a switching controller that controls turned-on states and turned-off states of the first and second switching devices such that first power is generated and output to the output terminal.

17. The organic light emitting display device of claim 10, wherein:

the reference voltage generator includes a required voltage generator and a reference voltage generator core, and the required voltage generator is connected between the power selector and the reference voltage generator core, and generates a required voltage to be supplied to a separate block using the reference power.

18. The organic light emitting display device of claim 17, wherein the reference voltage generator core generates the reference voltage based on the required voltage.

* * * * *